United States Patent [19]

Kuroki et al.

[11] 4,318,758

[45] Mar. 9, 1982

[54] METHOD FOR PRODUCING A GRAIN-ORIENTED MAGNETIC STEEL SHEET HAVING GOOD MAGNETIC PROPERTIES

[75] Inventors: Katsuro Kuroki; Kenzo Iwayama; Takashi Sato, all of Kitakyushu, Japan

[73] Assignee: Nippon Steel Corporation, Tokyo, Japan

[21] Appl. No.: 103,565

[22] Filed: Dec. 13, 1979

Related U.S. Application Data

[62] Division of Ser. No. 896,359, Apr. 13, 1978, abandoned.

[30] Foreign Application Priority Data

Apr. 18, 1977 [JP] Japan ..... 52/43482

[51] Int. Cl.[3] ..... H01F 1/04

[52] U.S. Cl. ..... 148/111; 148/31.5; 148/120

[58] Field of Search ..... 148/111–113, 148/120–122, 31.5, 12 A, 12.1

[56] References Cited

U.S. PATENT DOCUMENTS

| | | | |
|---|---|---|---|
| 1,965,559 | 7/1934 | Goss | 148/111 |
| 2,234,968 | 3/1941 | Hayes et al. | 148/120 |
| 2,473,156 | 6/1949 | Littmann | 148/12.5 |
| 3,130,093 | 4/1964 | Kohler | 148/113 |
| 3,287,183 | 11/1966 | Taguchi et al. | 148/111 |
| 3,409,480 | 11/1968 | Forslund | 148/113 |
| 3,528,863 | 9/1970 | Foster et al. | 148/113 |
| 3,647,575 | 3/1972 | Fiedler et al. | 148/111 |
| 3,947,296 | 3/1976 | Kamazawa | 148/111 |
| 3,976,518 | 8/1976 | Kuroki | 148/113 |
| 3,977,919 | 8/1976 | Foster et al. | 148/31.55 |

FOREIGN PATENT DOCUMENTS 45-17056 6/1970 Japan .

*Primary Examiner*—L. Dewayne Rutledge
*Assistant Examiner*—John P. Sheehan
*Attorney, Agent, or Firm*—Cushman, Darby & Cushman

[57] ABSTRACT

A grain oriented magnetic steel sheet having excellent magnetic properties containing not more than 4.5% silicon, in which a <001> axis of individual grains coincides with a rolling direction of the steel sheet, a crystal plane parallel to the steel sheet surface is composed of a {h, k, o} plane which is rotated and dispersed about an axis in the rolling direction, and a tension ranging substantially from 350 to 1500 g/mm$^2$ is given to the steel sheet in the rolling direction.

4 Claims, 9 Drawing Figures

FIG.1
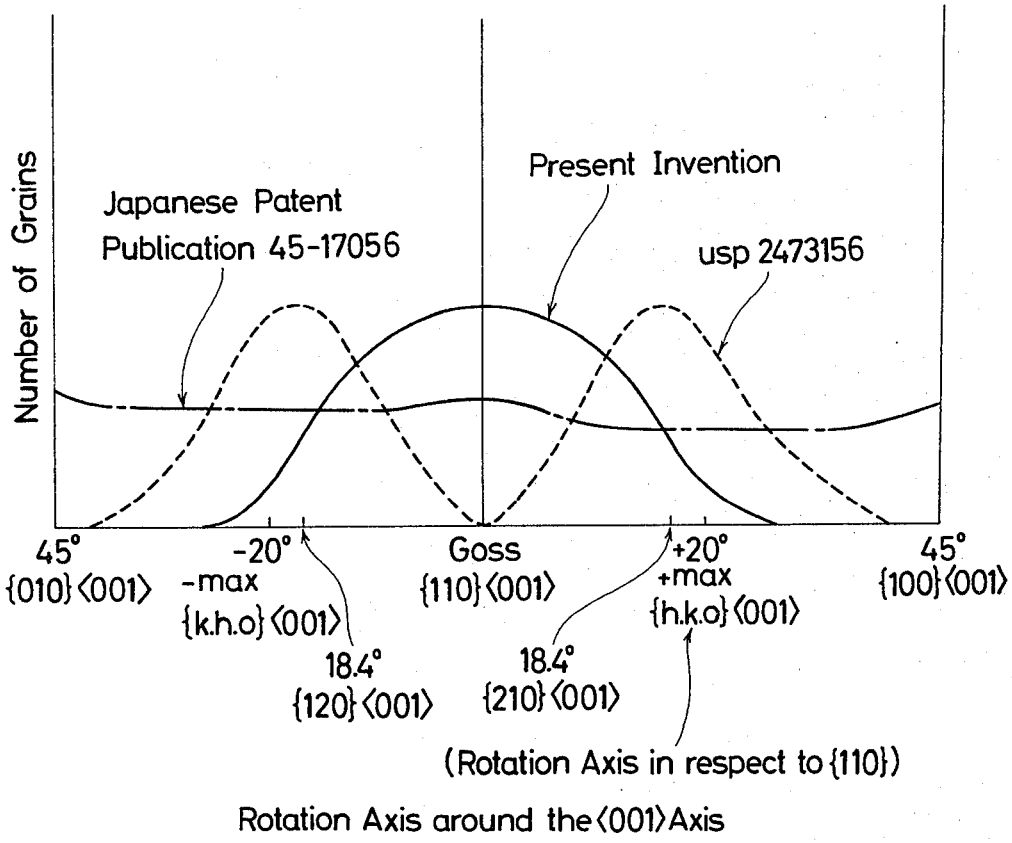
FIG.2 {110}⟨001⟩
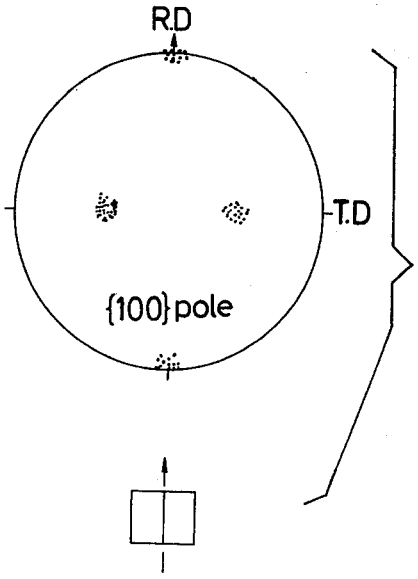
FIG.3 {hko}⟨001⟩
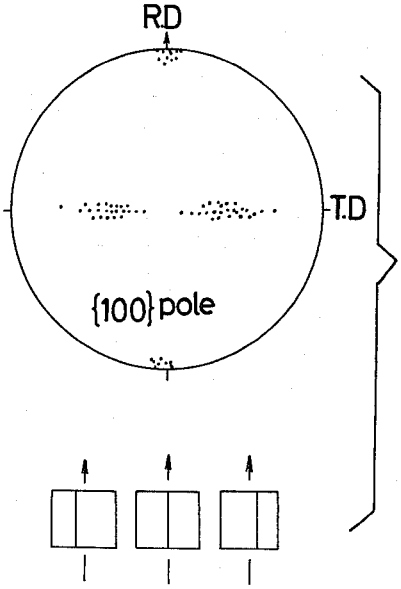

(a)

(b)

METHOD FOR PRODUCING A GRAIN-ORIENTED MAGNETIC STEEL SHEET HAVING GOOD MAGNETIC PROPERTIES

This is a division of application Ser. No. 896,359 filed Apr. 13, 1978, abandoned.

Field of the Invention

The present invention relates to a grain-oriented magnetic steel sheet with a high degree of grain orientation.

Magnetic steel sheets are widely used as core materials in motors, power transformers, generators and the like applications, and for these applications the magnetic steel sheets must have such magnetic properties that a large magnetic flux density can generally be obtained by a small exciting current and that the core loss value is so small as to assure efficient conversion of the supplied exciting current into a magnetization energy. The magnetic materials can be classified into two groups: one is a non-oriented magnetic material which is chiefly used in motors, and the other is a grain-oriented magnetic material which is mainly used in transformers, though partially used in large motors.

In short, the grain-oriented magnetic material is superior to the non-oriented magnetic material in that it shows far better magnetic properties in the rolling direction and a higher degree of grain orientation.

BACKGROUND OF THE INVENTION

Description of Prior Arts

A basic method for producing the grain-oriented magnetic steel sheet was disclosed by N. P. Goss in U.S. Pat. No. 1,965,559, and since then the grain-oriented magnetic steel sheets have been commercially produced thereby in a large amount. After the discovery of the basic method by N. P. Goss, the good magnetic properties of the grain-oriented magnetic steel sheets have been found by other researchers to be attributable to the fact that the grain orientation in these materials are in-comparably higher than that obtained by other magnetic materials known at that time.

In the grain-oriented magnetic steel sheets, the rolling direction coincides with the easily magnetizable crystal axes, namely <001> as defined by means of the Miller Crystallo-graphic Index System, and the steel sheet surface is composed of the grains having an orientation of {110}<001> which is parallel to the {110} plane, also as defined by means of the Miller Index.

Inventors and discoverers in the field of the grain orientation of grain-oriented magnetic steel sheets after the discovery of N. P. Goss were all, excepting a few, concerned with how to make the grain orientation follow the Goss's ideal grain orientation of {110}<001> for improvements of the magnetic flux density in the rolling direction, hence reduction of the core losses.

In particular, Taguchi et al disclosed in U.S. Pat. No. 3,287,183, a method which can produce, by a simplified process, a grain-oriented magnetic steel sheet having such a very high integration that the average displacement angle of individual grains from the ideal grain orientation of {100}<001> falls within a range of 3°, thus having a very high magnetic flux density in the rolling direction, and this method by Taguchi et al has been widely used on a larger commercial scale and has been replacing the Goss method.

Thus, to summarize, for the past ten years since the invention of the grain-oriented magnetic steel sheet by N. P. Goss, it has been generally considered to be best means for the improvement of the magnetic properties to approach the Goss's ideal orientation of {110}<001> as shown in FIG. 1.

SUMMARY OF THE INVENTION

One of the objects of the present invention is to provide a grain-oriented magnetic steel sheet having good magnetic properties with considerable advantages over the conventional grain-oriented magnetic materials, and the gist of the present invention lies in that the common conception for increasing the integration degree of the ideal Goss orientation has been broken by the present inventors, and although the crystal axis <001> is maintained parallel to the rolling direction just as the Goss orientation, the inclination of the planes is rotated and spread about the axis <001> and a certain amount of tension is given to the steel sheet.

More particularly, the present invention relates to improvements of a grain-oriented magnetic steel sheet containing silicon in an amount not more than 4.5%, and the improvements are characterized in that, in order to improve the core loss property in the rolling direction, the crystal axis <001> coincides with the rolling direction and the crystal plane parallel to the steel sheet surface consists of the plane {h, k, o}, rotated and dispersed about the <001> axis parallel to the rolling direction, and a tension ranging substantially from 350 to 1500 g/mm$^2$ is given to the steel sheet in the rolling direction.

More specifically, the improvements according to the present invention are further characterized in that the above rotation angles about the crystal axis <001> are spread substantially within an angle range from 0°-±20°, and consist of {h, k, o}<001>.

The improvements according to the present invention are still further characterized in that the tension given to the steel sheet is produced by means of an insulating film formed thereon.

The present invention is more advantageous when it is applied to a magnetic steel sheet having a thickness not thicker than 0.5 mm and having an average grain diameter not larger than 50 mm.

The {h, k, o}<001> orientation used in the present invention represents a texture in which at least 90% of the component grains are in such an arrangement of atoms that the {100} plane parallel to the rolling direction is rotated and dispersed about the <001> axis within an angle range from 0°-±20°, preferably 0°-±15°.

Regarding the production method for steel sheets having the {h, k, o}<001> grain orientation, a few methods have been proposed and disclosed.

According to U.S. Pat. No. 2,473,156, a grain-oriented magnetic material having the Goss {110}<001> orientation is rolled and annealed so as to obtain a thin gauge magnetic steel sheet having a grain orientation in which the <001> axis is parallel to the rolling direction and the {110} plane is rotated about the axis.

Japanese Patent Publication No. Sho 45-17056 discloses a method for producing the <001> texture by rolling and annealing a flat steel ingot.

More detailed explanations will be made hereinunder on the disclosures of U.S. Pat. No. 2,473,156 and Japanese Patent Publication No. Sho 45-17056 by reference to FIG. 1.

According to U.S. Pat. No. 2,473,156, the grains are distributed chiefly in the {120}<001> orientation. Thus, the crystal axis about the Goss orientation is rotated ±18.4° so as to improve the core loss property in the rolling direction, but the integration along the <001> axis in the rolling direction is considerably low and no {110}<001> orientation is seen. Due to the low grain integration along the <001> axis which is most desirable for a magnetic material, the $B_{10}$ property is only 18150 Gauss as shown in the examples of U.S. Pat. No. 2,473,156. Therefore, it is difficult to obtain a high-grade magnetic steel sheet according to U.S. Pat. No. 2,473,156.

According to Japanese Patent Publication No. Sho 45-17056, the rotation axis about the <001> axis rotates equally and therefore a double oriented texture is involved, with no consideration being made for approaching the Goss texture. Rather this prior art is considered to be directed to a double oriented magnetic steel sheet. Further, this prior art is not free from the defects of U.S. Pat. No. 2,473,156 and is considerably inferior to the Goss texture is respect with the magnetic properties in the rolling direction because the 90° magnetic domain is easily formed.

The present inventors have conducted extensive studies for overcoming the above mentioned disadvantages confronted with by the prior arts and have discovered that the core loss can be markedly reduced without deteriorating the grain orientation when the rotation angle of rotating axis about the <001> axis is maintained in a range from 0° to ±20°, more preferably from 0 to ±15°.

One of the most important features of the present invention is to give the steel sheet the grain orientation and the tension as specified hereinbefore.

Now detailed explanations will be made on these features.

First, regarding the grain orientation, the present invention intends to produce a grain orientation as shown in FIG. 3 as compared with the Goss orientation shown in FIG. 2. FIG. 3 illustrates an example in which the grains are rotated to a degree of about ±15° and dispersed around the <001> axis parallel to the rolling direction. The feature of the grain orientation according to the present invention lies in that the <001> axis of individual grains coincides with the rolling direction of the steel sheet and the crystal plane parallel to the steel sheet surface is composed of the {h, k, o} plane which is a rotated and dispersed {110} plane about its <001> axis parallel to the rolling direction.

Regarding the application of tension to the steel sheet, it is necessary to apply a tension substantially of 350 to 1500 g/mm$^2$ in the rolling direction in the case of the steel sheet having the grain orientation as defined above, and the tension may be usually applied by means of a glass-like film formed by MgO applied to the sheet surface, an insulating film applied after a finishing annealing and the like means.

The tension given to the steel sheet is produced during the cooling of heat treatment by the difference in thermal expansion between the steel sheet and the surface film. When a coating slurry applied on the steel sheet is baked and cured at a certain temperature, usually 350° C. or higher, the surface film thus formed adheres to the steel sheet under a state of no tension. However, once cooled, the steel sheet tends to contract more than the surface film because the steel sheet has generally a larger thermal expansion than the surface film.

In this case, so far as the surface film adheres to the steel sheet, the steel sheet is subjected to a tensile stress while the surface film is subjected to contraction, thus fitting to the steel sheet.

The present inventors have found that the positive application of tension to the steel sheet as above is effective to improve the magnetostriction and the core loss. As a specific method for applying the tension to the steel sheet, a coating slurry containing colloidal silica as main component, with addition of aluminum phosphate, one of chromic anhydride and chromate, and further silica powder and/or boric acid may be applied to the steel sheet and baked to form a surface film thereon.

However, the present invention should not be limited to the above specific coating slurry but any coating slurry which can form an insulating film capable of producing the tension as described above may be used.

BRIEF EXPLANATION OF THE DRAWINGS

The present invention will be described in more details referring to the attached drawings.

FIG. 1 shows schematically the rotating axis about the <001> axis in the present invention in comparison with a conventional art.

FIG. 2 shows the {100} pole figures of grain orientation and the crystal arrangement of a conventional magnetic steel sheet ({110}<001> Goss texture).

FIG. 3 shows the {100} pole figures of the grain orientation and the crystal arrangement of a magnetic steel sheet according to the present invention ({h, k, o}<001> texture).

FIG. 5(*b*) shows the {100} pole figures of the grains and the developments of the secondary recrystallization grains in the comparison sheet referred to in Example 3.

Detailed explanations on the reasons for the limitations of the tension to be applied to the steel sheet will be made hereinunder in connection with some embodiments by reference to FIG. 4. In FIG. 4, the core loss value (marked with o) of a conventional steel sheet having the Goss orientation is compared with that of a steel sheet (marked with •) having a grain orientation rotated and dispersed about the <001> axis parallel to the rolling direction according to the present invention (excepting those having a grain size of 60 mm). The comparison is made in corelation with the tension given to the steel sheet.

Figure 4:
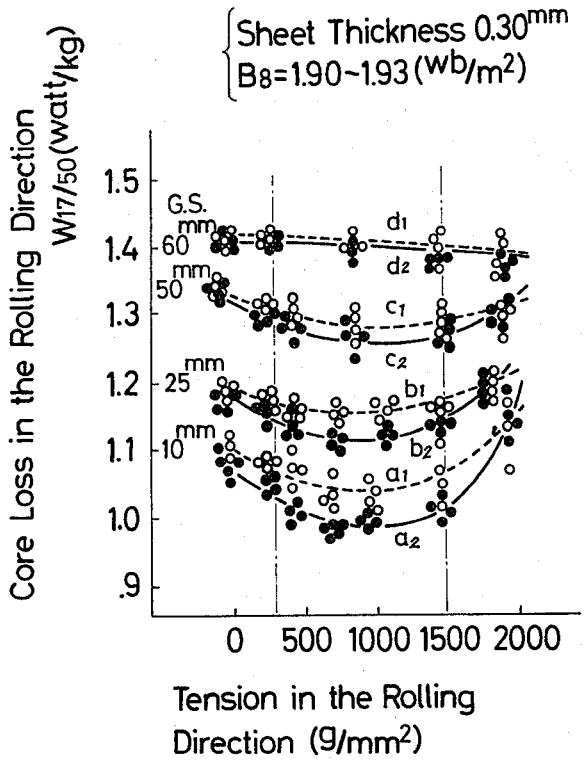
FIG. 4 shows the relation between the core loss values and various tensions applied in the rolling direction to steel sheets having grain sizes of 10 mm, 25 mm, 50 mm and 60 mm, in which o represents sheets having a conventional grain orientation and • represents sheets having the grain orientation according to the present invention.

It is clearly understood from the figure that when the average grain diameter is relatively large as 60 mm, there is no distinctive difference between the conventional material ($d_1$) having the Goss orientation and the steel sheet ($d_2$) having the grain orientation rotated and dispersed around the <001> axis parallel to the rolling direction, but in the case of materials having an average grain diameter of not larger than 50 mm as specified in the present invention, for example in the case of the average diameters of 10 mm and 25 mm, the materials ($a_2$, $b_2$, $c_2$) according to the present invention show a marked improvement of the core loss value as compared with the conventional material ($a_1$, $b_1$, $c_1$) having the Goss orientation, particularly when the tension given to the steel sheet falls within the range from 350 to 1500 g/mm$^2$ as defined in the present invention.

Although the mechanism through which the core loss can be improved in the present invention has not been clarified, it may be assumed as below.

As well known, when a magnetic field is applied to a ferromagnetic, magnetic steel sheet, movement of the magnetic domain walls and rotation of the magnetic domain are caused in the steel sheet and thereby the steel sheet is magnetized. Particularly in an alternating magnetic field, the movement and rotation of the magnetic domain are caused in a continuous manner and, as well known, are accompanied by core losses, such as hysteresis loss and eddy current loss.

The improvement of the core loss according to the present invention is assumed to be connected with subdivision of the magnetic domains due to the specific grain orientation and the specific tension given to the sheet, hence connected with reduction of the movement distance of individual magnetic domain walls and thus reduction of the eddy current loss.

In ordinary magnetic materials in which the individual grains are arranged in the ideal Goss orientation {110}<001> or in a grain orientation very close to the Goss orientation, the orientation difference between the adjacent grains is very small. However, in the magnetic material according to the present invention, in which the grains are arranged in the {h, k, o}<00> orientation, the orientation difference between the adjacent grains is considerably large, as compared with that in the ordinary magnetic materials. The very fact that the difference is larger indicates the ordinary materials and the material according to the present invention have a different grain boundary structure.

Also, when a tension has been given to the steel sheet, the grain boundaries serve as a stress center due to lattice defects and the magnetic domains are finely divided, thus contributing to the reduction of eddy current loss.

It may be assumed that the improvement of core loss obtained by the present invention is due to the fact that the steel sheet having the {h, k, o}<001> orientation is given by the tension a grain boundary structure suitable to cause a stress center which causes the fine division of the magnetic domain, thus resulting in the improvement of the iron loss.

In the magnetic steel sheet according to the present invention, the core loss particularly in the rolling direction is improved by the correlative mechanism between the specific grain orientation and the specific tension given to the sheet, but it should be noted that the magnetic properties in other directions than the rolling direction are improved by the specific grain arrangement of {h, k, o}<001> alone, because the <111> component in the sheet plane is reduced or almost nullified.

The present invention is not a mere aggregation of the known feature of the <001> fibrous texture and the feature of tension application of the Goss magnetic steel sheet, as is clearly understood from the considerable difference between the values marked with o and those marked with • in FIG. 4. If the present invention were a mere aggregation of the above features, the same tension characteristics as the materials having the Goss orientation would be produced so far as the magnetic properties are measured in the rolling direction. However, in fact, the magnetic steel sheets having the {h, k, o}<001> orientation show far much improvement of the core loss particularly when the tension is within the range from 350 to 1500 g/mm$^2$ as shown in FIG. 4.

This remarkable improvement as explained hereinbefore, can be attributed to the fact that the sensitivity of the grain bounderies to the fine division of the magnetic domains is far larger than that of the materials having the Goss orientation, and this improvement can not be expected from a mere combination of the known facts.

Regarding the grain orientation, the term {h, k, o}<001> is used in the present invention for generalization. However, according to the results of more detailed studies, it has been found that the grain dispersion within ±15°-±20° about the Goss orientation {110}<001> seems to produce the most desirable results. This is considered to be due to the fact that when the rotation and dispersion increases and the {100}<001> components are increased, the 90° magnetic domains also increases.

Reasons for various limitations defined in the present invention will be explained hereinbelow.

The silicon content is limited to an amount not more than 4.5% in the present invention. As well known, the silicon is effective to the electrical resistance of a steel sheet and to improve markedly the core loss value. However, with silicon contents beyond 4.5%, the workability of the steel sheet deteriorates, and thus the upper limit of the silicon content is set at 4.5%, and usually the silicon is contained in an amount of about 3%.

Meanwhile, there are some conventional grades of a grain-oriented magnetic steel sheet for special applications, which contain no silicon or a very small amount of silicon. The present invention is also successfully applicable to such conventional grades of grain-oriented magnetic steel sheet. Therefore, in the present invention, the lower limit of the silicon content is set substantially at 0%.

In the present invention, there are no specific limitations regarding the other chemical components, and such elements as Mn, S, Al, N and further Ti, V, Nb, Se and Sb which are required in ordinary grain-oriented magnetic electrical steel sheets may be contained singly or in combination.

Regarding the thickness of the magnetic steel sheet according to the present invention, when the thickness is thicker than 0.5 mm, it is sometimes practically difficult to apply a tension to the steel sheet, so that the desired improvement of core loss values by the application of a specific tension in combination with the specific grain orientation which is the main feature of the present invention becomes substantially small so that the desired improvement of magnetic properties of the present invention can not be sometimes achieved.

Regarding the average diameter of the grains in the magnetic steel sheet according to the present invention, when the diameter is larger than 50 mm, the improvement of core loss values becomes small as illustrated in FIG. 4.

Therefore, grain diameters not larger than 50 mm are desirable in the present invention. The reason why the improvement of core loss values is reduced as the grain size increases has not yet been clarified, but it may well be assumed that a certain upper limit of the grain size exists if the desired results of the present invention derive from the specific grain boundary structure as described hereinafter.

DESCRIPTION OF PREFERRED EMBODIMENTS

Example 1

Hot rolled steel sheets of 2.3 mm and 3 to 7.5 mm thickness were obtained from several ten grades of steel ingots prepared in a vacuum melting furnace of 50 kg capacity and having a chemical composition:

Si: 2.7–3.1%
C: 0.04–0.06%
Mn: 0.07–0.10%
S: 0.022–0.028%
Al: 0.024–0.031%
N: 0.0045–0.0085%
Fe: balance As an illustration of a conventional method for comparison, the hot rolled steel sheets of 2.3 mm in thickness which has been annealed at 1100° C. are subjected to a cold rolling with 88% reduction, followed by a decarburization annealing at 830° C. and a high temperature annealing at 1150° C. according to the disclosure of U.S. Pat. No. 3,287,183 to obtain a grain-oriented magnetic steel sheet of 0.30 mm in thickness.

Meanwhile, for the production of various grades of steel sheets having the {h, k, o}<001> grain orientation, the hot rolled steel sheets of 3 to 7.5 mm thickness are annealed at 1000° C. for five minutes followed by cold rolling into 2.3 mm thickness, annealing at 900° C., cold rolling into 0.30 mm thickness, decarburization annealing at 850° C., and annealing at 1200° C. for 20 hours in a hydrogen gas flow to obtain a magnetic steel sheet in which the orientation of the secondary recrystallization grains is rotated 0°–45° around the axis <001> parallel to the rolling direction. The steel sheet thus obtained having secondary grains arranged in the Goss orientation and the {h, k, o}<001> orientation are coated with a coating liquid on both sides of the sheet in an amount of 2 to 8 g/m$^2$ for each side. The coating liquid is composed of Water dispersion of 20% colloidal silica: 100 cc
Aqueous solution of 50% aluminum phosphate: 60 cc
Chromic anhydride: 6 g
Boric acid: 2 g This coating liquid is useful for applying a high tension. For applying a low tension, a coating liquid composed of phosphates such as magnesium phosphate may be used.

The steel sheets thus coated with the coating liquid are subjected to baking in a nitrogen atmosphere at a temperature from 750° to 850° C. for 10 to 30 seconds in a continuous furnace to retain in the steel sheets a residual stress corresponding to the tension applied. The magnitude of the tensions is calculated from the bending of the steel sheet caused when the coating on one side is removed by chemical polishing without causing any strain.

The relation between the core loss in the rolling direction and the tension in the steel sheet thus obtained is shown in FIG. 4, in which the measurement points (marked with o) represent the values obtained by the conventional materials $a_1$, $b_1$, $c_1$ and $d_1$ having the grains about the conventional Goss orientation. These points indicate that the core loss value changes to have a minimum value depending on the tension applied. Meanwhile, the measurement points (marked with •) represent the values obtained by the steel sheets $a_2$, $b_2$, $c_2$ and $d_2$ having the {h, k, o}<001> grain orientation when similar tensions are given. It is clear from FIG. 4 that the core loss values are improved over the points marked with o at any measurement point in the steel sheets ($a_2$, $b_2$ and $c_2$) within the scope of the present invention. Thus, in the case of the steel sheets ($a_1$ and $a_2$) having an average grain diameter of 10 mm, although the core loss index W17/50 lowers in the conventional material of the Goss orientation when an appropriate tension is given, it almost never gets below 1.0 watt/kg, while in the materials having the {h, k, o}<001> orientation and given a tension of about 700 g/mm$^2$, the core loss index very often gets considerably below 1.0 watt/kg, e.g. 0.97 watt/kg.

It is clearly understood from the above illustration, the present invention produces marked results.

Example 2

A continuously cast steel slab having the composition stated below is hot rolled to obtain ten hot rolled steel sheets of 2.3 mm in thickness.

Si: 2.97%
C: 0.052%
Mn: 0.085%
S: 0.026%
Al: 0.029%
N: 0.0078%
Balance: substantially Fe The hot rolled steel sheets are annealed at 1130° C., acid pickled, cold rolled into 0.30 mm by a method mentioned hereinafter, and subjected to decarburization annealing at 845° C. Then the sheets are coated with magnesium oxide and subjected to a final finishing annealing at 1190° C. Then just as in Example 1 the sheets are coated with a coating liquid composed of:

Water dispersion of 20% colloidal silica: 100 cc
50% Aluminum phosphate aqueous solution: 60 cc
Chromic anhydride: 6 g
Boric acid: 2 g to form a tension film on the sheets. The sheets thus coated are heated at 830° C. to bake the film and to level the sheets.

For conducting the above cold rolling, five sheets are cold rolled as described below to illustrate the present invention, while the remaining five sheets are coled rolled with oridinary non-grooved rolls for comparison. The first five sheets are cold rolled using the following two types of grooved rolls in addition to the ordinary non-grooved rolls. One type of the grooved rolls is used for cold rolling the sheet of 2.3 mm in thickness to 1.60 mm, and has the following groove configuration: V shape, with an opening angle of 90°, groove depth of 0.25 mm, groove pitch of 3.5 mm, and the grooves are arranged in a slanted check pattern crossing each other at 20° to the direction perpendicular to the roll axis. The rolls have a diameter of 130 mm. The steel sheet of 2.3 mm in thickness is cold rolled by a pair of the above grooved rolls to a maximum thickness of 1.60 mm and then further cold rolled by the following grooved rolls to 0.85 mm in thickness.

This latter type of the grooved rolls has the following groove configuration: V shape, with an opening angle of 120°, groove depth of 0.15 mm, groove pitch of 2.0 mm, and the grooves are arranged in a slanted check pattern crossing each other at 25° to the direction perpendicular to the roll axis. The roll has a diameter of 130 mm, and the rolling is done by a pair of grooved rolls of this type.

In this way, the sheet of 2.3 mm in thickness is cold rolled to 0.85 mm by the above two types of grooved rolls to give a grooved surface pattern to the sheet, and then the sheet is cold rolled to 0.30 mm by ordinary flat rolls, to give a surface almost same as that obtained by cold rolling the sheet only with the flat rolls.

The magnetic properties of the above two groups (a) and (b) of the products are shown in the following Table.

TABLE

| | $B_8$ (wb/m$^2$) | W17/50 (watt/kg) |
|---|---|---|
| Group (a) Present invention | 1.93–1.95 (average: 1.94) | 0.98–1.05 (average: 1.02) |
| Group (b) Comparison | 1.93–1.95 (average: 1.94) | 1.07–1.21 (average 1.12) |

Figure 5A:
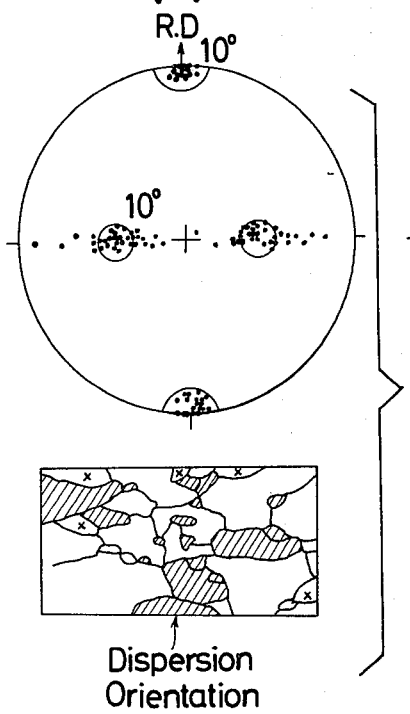
FIG. 5(*a*) shows the {100} pole figures of the grains and the developments of the secondary recrystallization grains in the sheet obtained in Example 3 of the present invention.
Figure 5B:
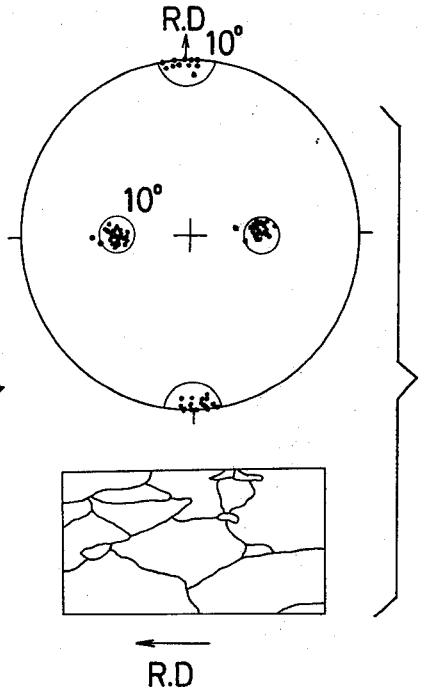

The above two groups of products are acid pickled to expose the secondary recrystallization grains, and FIG. 5(*a*) shows the orientation of individual grains plotted in the {100} pole figures and the appearance of grains in the group (a), and FIG. 5(*b*) shows the same in the group (b).

It has been revealed by the same measurement as in Example 1 that the tension in the rolling direction given by the glass-like film or tension film formed on the products is about 800 g/mm$^2$ in both groups (a) and (b) of products. The grain size in both groups of products is not larger than 50 mm.

The grain orientation in the group (a) cold rolled by the grooved rolls contains not only ordinary grains having the Goss orientation but also a number of grains having the Goss orientation rotated and dispersed in the following direction.

The latter grains having the {h, k, o}<001> dispersed orientation are secondary recrystallization grains having a relatively small size, which are scattered among the Goss orientation grains having a relatively large size.

Concludingly, the product group (a) cold rolled by means of the grooved rolls according to the present invention shows very excellent core loss value, such as W17/50: 1.02 watt/kg in average. Thus the results of the present invention are very remarkable as compared with the conventional magnetic materials.

Example 3

A continuously cast steel slab having the following composition is heated and hot rolled into a hot rolled steel sheet of 2.3 mm in thickness.

C: 0.053%
Si: 2.95%
Mn: 0.07%
S: 0.023%
Al: 0.028%
N: 0.007%
Balance: Fe and unavoidable impurities Then the hot rolled steel sheet is heated at 1120° C. for 2 minutes, cooled in air and rapidly cooled with water spray from 950° C. to near the room temperature. The sheet thus rapidly coold is acid pickled, then cold rolled in a single step to a final thickness of 0.30 mm, and subjected to decarburization annealing at 850° C. for 3 minutes in a mixture gas flow of 75% hydrogen and 25% nitrogen (dew point 60° C.).

After the decarburization annealing, the sheet was coated with an annealing separator of the composition:

Water: 1000 cc
MgO: 100 g
$TiO_2$: 5 g
$Na_2S_2O_3$: 0.5 g and then subjected to a finish anneal under the following condition.

Figure 6:
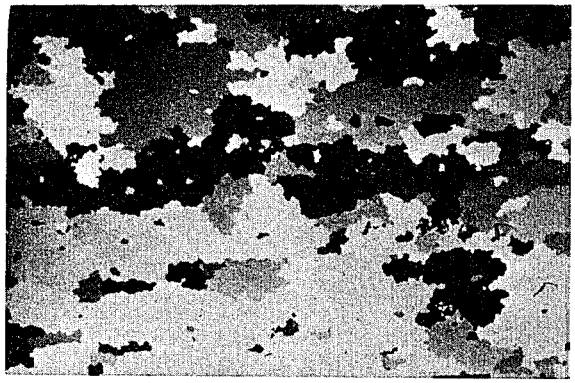
FIG. 6(*a*) shows a macro-structure of the sheet obtained in Example 3 of the present invention, and FIG. 6(*b*) shows a macro-structure of the comparison sheet referred to in Example 3.
Figure 6:
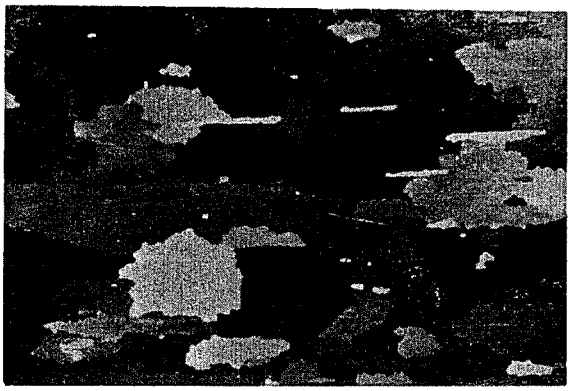
Figure 7:
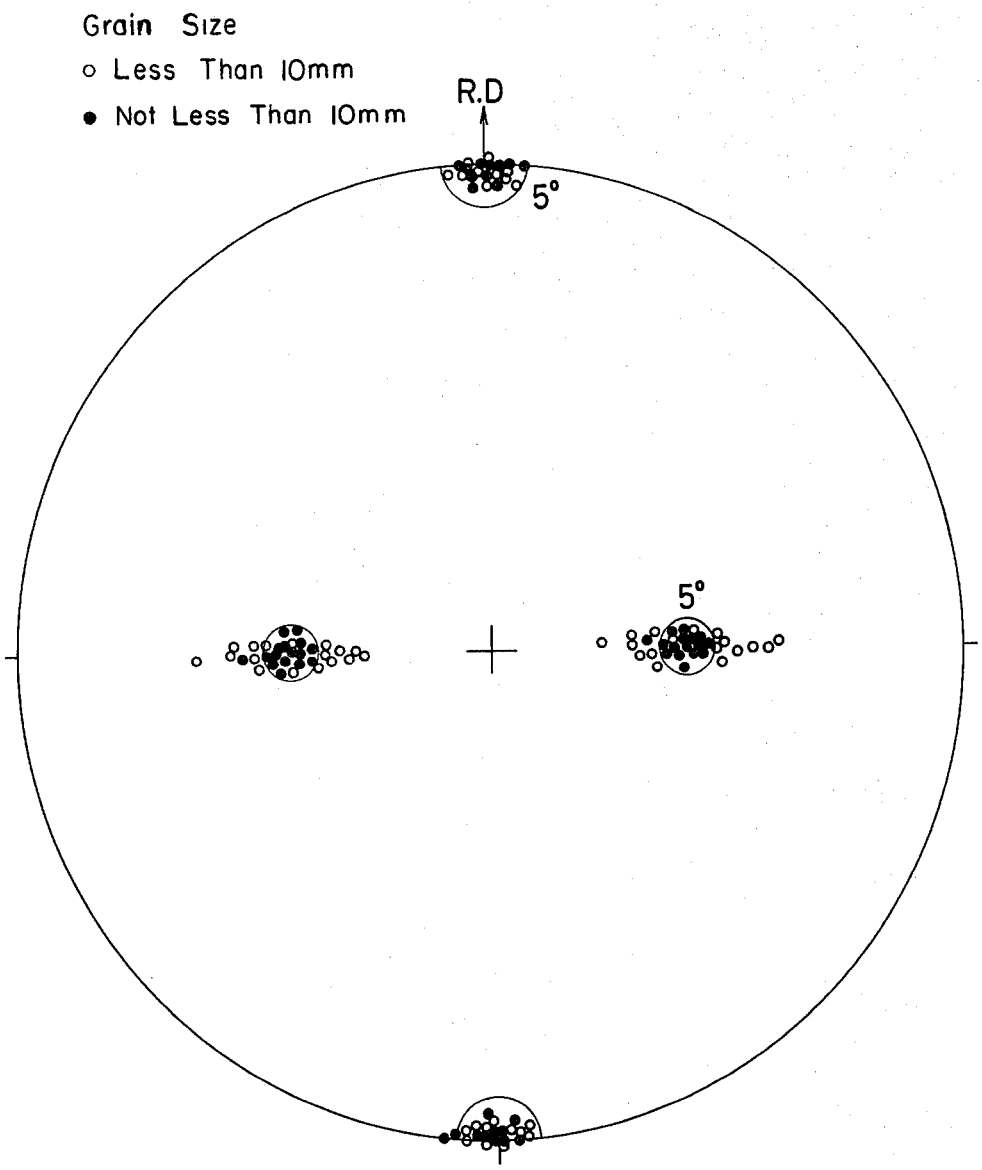
FIG. 7 is the {100} pole figures of the grains in the sheet obtained in Example 3 of the present invention.

Up to 900° C. : in 75% hydrogen and 25% nitrogen with a heating ratio of 20° C./hr.
Between 900° and 1050° C.: in 75% hydrogen and 25% nitrogen with a heating ratio of 5° C./hr.
Between 1050° and 1200° C.: in 100% hydrogen with a heating ratio of 20° C./hr.
1200° C.: maintained for 20 hours in 100% hydrogen A similar insulating film as in Example 2 was formed on the sheet in a similar way, and the resultant sheet shows a very low core loss value as $B_8$=1.96T and W17/50=0.94 w/kg. The macro structure of the sheet is shown in FIG. 6(*a*) in comparison with FIG. 6(*b*) showing the macro structure of a similar sheet subjected to an ordinary finishing annealing by heating to 1200° C. with a constant heating ratio of 20° C./hr. The magnetic properties of the sheet for the comparison is: $B_8$=1.94T, and W17/50=1.05 w/kg. The {100} pole figure of the sheet shown in FIG. 6(*a*) is shown in FIG. 7. In FIG. 7, o indicates grain size less than 10 mm and • indicates grain size not less than 10 mm.

The structure of the sheet produced according to this example is characterized in that most of the larger grains (10mm or larger) are very close to the Goss orientation of {110}<001> and are tilted within 5° around the Goss orientation, while most of the smaller grains (smaller than 10 mm) are rotated in a range from 5° to 20° about the axis <001>.

What is claimed is:

1. A method for producing a grain oriented magnetic steel sheet having excellent magnetic properties and containing not more than 4.5% silicon, comprising hot rolling a steel slab prepared by continuous casting, subjecting the hot rolled steel sheet thus obtained to intermediate annealing, then to cold rolling by means of a grooved roll to produce a steel structure in which a <001> axis of individual grains coincides with a rolling direction of the steel sheet, a crystal plane (h, k, o) parallel to the steel sheet surface plane is rotated and dispersed about an axis in the rolling direction in a range from 0° to ±20°, subjecting the cold rolled steel sheet thus obtained to decarburizing annealing, magnesium oxide coating, final annealing and then coating the steel sheet with a coating liquid containing colloidal silica, aluminum phosphate, chromic anhydride and boric acid so as to give a tension during cooling, ranging substantially from 350 to 1500 g/mm$^2$ in the rolling direction to the steel sheet.

2. The process of claim 1 wherein the coating liquid is an aqueous coating liquid containing the solid components in the ratio of 20 parts colloidal silica, 30 parts aluminum phosphate, 6 parts chromic anhydride and 2 parts boric acid.

3. The process of claim 2 where is employed a final annealing coating composition containing on a solid basis 100 parts magnesium oxide, 5 parts titanium oxide and 0.5 parts $Na_2S_2O_3$.

4. The process of claim 1 wherein there is employed a final annealing coating composition containing on a solid basis 100 parts magnesium oxide, 5 parts titanium oxide and 0.5 parts $Na_2S_2O_3$.

* * * * *